US006672104B2

(12) United States Patent
Kimble et al.

(10) Patent No.: US 6,672,104 B2
(45) Date of Patent: Jan. 6, 2004

(54) RELIQUEFACTION OF BOIL-OFF FROM LIQUEFIED NATURAL GAS

(75) Inventors: E. Lawrence Kimble, Sugar Land, TX (US); Ronald R. Bowen, Magnolia, TX (US); James R. Rigby, Kingwood, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 10/397,406

(22) Filed: Mar. 26, 2003

(65) Prior Publication Data

US 2003/0182947 A1 Oct. 2, 2003

Related U.S. Application Data

(60) Provisional application No. 60/368,325, filed on Mar. 28, 2002.

(51) Int. Cl.[7] ..... F25J 1/00
(52) U.S. Cl. ..... 62/613; 62/48.2; 62/614
(58) Field of Search ..... 62/48.2, 611, 613, 62/614

(56) References Cited

U.S. PATENT DOCUMENTS

| | | | | |
|---|---|---|---|---|
| 3,735,600 A | | 5/1973 | Dowdell et al. | 62/39 |
| 3,857,245 A | | 12/1974 | Jones | 60/651 |
| 3,857,251 A | | 12/1974 | Alleaume | 62/28 |
| 3,874,185 A | | 4/1975 | Etzbach | 62/40 |
| 3,885,394 A | | 5/1975 | Witt et al. | 60/651 |
| 3,919,852 A | | 11/1975 | Jones | 62/7 |
| 3,919,853 A | | 11/1975 | Rojey | 62/9 |
| 4,187,689 A | | 2/1980 | Selcukoglu et al. | 62/54 |
| 4,320,303 A | | 3/1982 | Ooka et al. | 290/1 R |
| 4,689,962 A | | 9/1987 | Lofredo | 62/54 |
| 4,727,723 A | | 3/1988 | Durr | 62/54 |
| 4,750,333 A | | 6/1988 | Husain et al. | 62/118 |
| 4,840,652 A | | 6/1989 | Simon et al. | 62/534 |
| 4,843,829 A | | 7/1989 | Stuber et al. | 62/54.2 |
| 4,846,862 A | | 7/1989 | Cook | 62/9 |
| 5,006,138 A | | 4/1991 | Hewitt | 62/18 |
| 5,076,822 A | | 12/1991 | Hewitt | 62/18 |
| 5,389,242 A | | 2/1995 | Lermite et al. | 208/347 |
| 5,402,645 A | | 4/1995 | Johnson et al. | 62/23 |
| 5,950,453 A | * | 9/1999 | Bowen et al. | 62/612 |
| 5,956,971 A | * | 9/1999 | Cole et al. | 62/623 |
| 6,023,942 A | * | 2/2000 | Thomas et al. | 62/613 |
| 6,192,705 B1 | | 2/2001 | Kimble, III | 62/613 |
| 6,250,244 B1 | | 6/2001 | Dubar et al. | 114/264 |

FOREIGN PATENT DOCUMENTS

| | | |
|---|---|---|
| EP | 1132698 A1 | 9/2001 |
| GB | 2333149 A | 7/1999 |
| WO | WO 90/00589 | 1/1990 |

* cited by examiner

*Primary Examiner*—Henry Bennett
*Assistant Examiner*—Malik N. Drake
(74) *Attorney, Agent, or Firm*—Marcy Hoefling

(57) ABSTRACT

A process is provided for converting a boil-off stream comprising methane to a liquid having a preselected bubble point temperature. The boil-off stream is pressurized, then cooled, and then expanded to further cool and at least partially liquefy the boil-off stream. The preselected bubble point temperature of the resulting pressurized liquid is obtained by performing at least one of the following steps: before, during, or after the process of liquefying the boil-off stream, removing from the boil-off stream a predetermined amount of one or more components, such as nitrogen, having a vapor pressure greater than the vapor pressure of methane, and before, during, or after the process of liquefying the boil-off stream, adding to the boil-off stream one or more additives having a molecular weight heavier than the molecular weight of methane and having a vapor pressure less than the vapor pressure of methane.

9 Claims, 2 Drawing Sheets

RELIQUEFACTION OF BOIL-OFF FROM LIQUEFIED NATURAL GAS

This application claims the benefit of U.S. Provisional Application No. 60/368,325, filed Mar. 28, 2002.

FIELD OF THE INVENTION

This invention relates generally to an improved process for reliquefaction of boil-off from methane-rich liquefied gas such as boil-off from liquefied natural gas ("LNG") or boil-off from pressurized liquefied natural gas ("PLNG").

BACKGROUND OF THE INVENTION

Because of its clean burning qualities and convenience, natural gas has become widely used in recent years. Many sources of natural gas are located in remote areas, great distances from any commercial markets for the gas. Sometimes a pipeline is available for transporting produced natural gas to a commercial market. When pipeline transportation is not feasible, produced natural gas is often processed into liquefied natural gas ("LNG") for transport to market at or near ambient pressure and at a temperature of about −162° C. (−260° F.).

The source gas for making LNG is typically obtained from a crude oil well (associated gas) or from a gas well (non-associated gas). Associated gas occurs either as free gas or as gas in solution in crude oil. Although the composition of natural gas varies widely from field to field, the typical gas contains the hydrocarbon methane ($C_1$) as a major component. The natural gas stream may also contain the hydrocarbon ethane ($C_2$), higher hydrocarbons ($C_{2+}$), and minor amounts of contaminants such as carbon dioxide ($CO_2$), hydrogen sulfide ($H_2S$), nitrogen ($N_2$), iron sulfide, wax, and crude oil. The solubilities of the contaminants vary with temperature, pressure, and composition. At cryogenic temperatures, $CO_2$, water, other contaminants, and certain heavy molecular weight hydrocarbons can form solids, which can potentially plug flow passages in liquefaction process equipment. These potential difficulties can be avoided by removing such contaminants and heavy hydrocarbons from the natural gas stream prior to liquefaction.

It has also been proposed to transport natural gas at temperatures above −112° C. (−170° F.) and at pressures sufficient for the liquid to be at or below its bubble point temperature. This pressurized liquid natural gas is referred to in this specification as "PLNG" to distinguish it from LNG, which is transported at near atmospheric pressure and at a temperature of about −162° C. (−260° F.).

Because PLNG typically contains a mixture of low molecular weight hydrocarbons and other substances, the exact bubble point temperature of PLNG is a function of its composition. For most natural gas compositions, the bubble point pressure of the natural gas at temperatures above −112° C. (−170° F.) will be above 1,380 kPa (200 psia). One of the advantages of producing and shipping PLNG at a warmer temperature than LNG is that PLNG can contain considerably more $C_{2+}$ components than can be tolerated in most LNG applications.

Depending upon market prices for ethane, propane, butanes, and heavier hydrocarbons (collectively referred to herein as "NGL products"), it may be economically desirable to transport the NGL products with the PLNG and to sell them as separate products. International Publication No. WO 90/00589 (Brundige) discloses a process of transporting pressurized liquid heavy gas containing butane and heavier components, including condensable components that are deliberately and intentionally left in the liquefied natural gas. In the Brundige process, basically the entire natural gas composition, regardless of its origin or original composition, is liquefied without removal of various gas components. This is accomplished by adding to the natural gas an organic conditioner, preferably $C_2$ to $C_5$ hydrocarbons to change the composition of the natural gas and thereby form an altered gas that is in a liquid state at a selected storage temperature and pressure. Brundige allows the liquefied product to be transported in a single vessel under pressurized conditions at a higher temperature than conventional LNG.

In the storage, transportation, and handling of PLNG, there can be a considerable amount of boil-off, which boil-off is primarily in the gaseous or vapor phase. In many applications in which boil-off is produced, it is desirable to reliquefy the boil-off and combine it with the liquid that produced the boil-off. PLNG boil-off can typically be reliquefied using the same process used to produce PLNG. However, since PLNG often contains an appreciable quantity of nitrogen, this nitrogen will, as a result of its lower boiling point compared with other constituents of natural gas, evaporate preferentially and form a significant portion of the boil-off. For example, for PLNG at 450 psia containing 0.1% nitrogen, boil-off may contain as much as 3% nitrogen. At a given pressure, reliquefaction of the boil-off will therefore require cooling of the boil-off to a lower temperature than required to liquefy the liquid from which the boil-off was produced. Various reliquefaction processes have been proposed for handling nitrogen-rich boil-off.

U.S. Pat. No. 3,857,245 (Jones) discloses a process of condensing a nitrogen-containing boil-off in which LNG is injected into the nitrogen-containing boil-off vapor and the combined mixture is then condensed. The injection of the LNG into the nitrogen-containing boil-off increases the volume of vapor that must be reliquefied.

U.S. Pat. No. 6,192,705 (Kimble) discloses a process of passing boil-off through a heat exchanger followed by compressing and cooling stages, and then recycling the boil-off back through the heat exchanger. The compressed, cooled, and then heated boil-off is subsequently expanded and passed to a gas-liquid separator for removal of liquefied boil-off. The liquefied boil-off is then combined with a second liquefied gas stream to produce a desired product stream.

One problem encountered with reliquefaction processes proposed in the past is that the reliquefied boil-off may have a lower (colder) bubble point temperature than that of the bulk cargo liquid that produced the boil-off. This lower temperature can be undesirable if it exceeds the lower allowable limit of the operating temperature of the transport containers. A need therefore exists for an improved process for re-liquefying PLNG boil-off to overcome the temperature disparity between the bulk bubble point temperature of the liquefied cargo and the bubble point temperature of the liquefied boil-off.

SUMMARY OF THE INVENTION

This invention relates to a method of converting a boil-off stream comprising methane to a liquid having a preselected bubble point temperature, comprising the steps of: (a) pressurizing the boil-off stream; (b) cooling the pressurized boil-off stream of step (a); (c) expanding the cooled, pressurized boil-off stream of step (b), thereby producing pressurized liquid; and (d) obtaining the preselected bubble point temperature of the pressurized liquid by performing at least one of the following steps:

i. before, during, or after one or more of steps (a) to (c), removing from the boil-off stream a first predetermined amount of one or more components having a vapor pressure greater than the vapor pressure of methane, and ii. before, during, or after one or more of steps (a) to (c), adding to the boil-off stream a second predetermined amount of one or more additives having a molecular weight heavier than the molecular weight of methane and having a vapor pressure less than the vapor pressure of methane, wherein the first predetermined amount of the one or more components removed and the second predetermined amount of the one or more additives added are controlled to obtain the preselected bubble point temperature of the pressurized liquid. If desired, the multi-component boil-off stream can be warmed prior to the first pressurization. In one embodiment of the method of this invention, the one or more components removed from the boil-off stream comprise nitrogen. In one embodiment of this invention, the one or more additives added to the boil-off stream comprise one or more $C_{2+}$ hydrocarbons. One embodiment of this invention further comprises combining the pressurized liquid having the preselected bubble point temperature with a second pressurized liquid having substantially the same bubble point temperature; and sometimes the second pressurized liquid produced the boil-off stream being liquefied. One embodiment of this invention further comprises before step (d), determining an amount of a first component of said one or more components to be removed from the boil-off stream, the first component having a vapor pressure greater than the vapor pressure of methane, and determining an amount of a first additive of said one or more additives to be added to the boil-off stream, the first additive having a molecular weight heavier than the molecular weight of methane and having a vapor pressure less than the vapor pressure of methane, both of said determinations being performed by determining the composition of the boil-off stream and performing an equation of state analysis to determine a pressurized liquid composition needed to obtain the preselected bubble point temperature in said pressurized liquid at a preselected pressure. Another embodiment of this invention further comprises before step (d), determining the first predetermined amount of the one or more components to be removed from the boil-off stream, and determining the second predetermined amount of the one or more additives to be added to the boil-off stream, both of said determinations being performed by determining the composition of the boil-off stream and performing an equation of state analysis to determine a pressurized liquid composition needed to obtain the preselected bubble point temperature in said pressurized liquid at a preselected pressure.

In one embodiment, this invention relates to a method of converting a boil-off stream comprising methane to a liquid having a preselected bubble point temperature, comprising the steps of: (a) pressurizing the boil-off stream; (b) cooling the pressurized boil-off stream of step (a); (c) expanding the cooled, pressurized boil-off stream of step (b), thereby producing pressurized liquid; and (d) obtaining the preselected bubble point temperature of the pressurized liquid by performing at least one of the following steps:

i. before, during, or after one or more of steps (a) to (c), removing from the boil-off stream a first predetermined amount of nitrogen, and ii. before, during, or after one or more of steps (a) to (c), adding to the boil-off stream a second predetermined amount of one or more $C_{2+}$ hydrocarbons, wherein the first predetermined amount of the nitrogen removed and the second predetermined amount of the one or more $C_{2+}$ hydrocarbons added are controlled to obtain the preselected bubble point temperature of the pressurized liquid.

In one embodiment, this invention relates to a method of converting a boil-off stream comprising methane to a liquid having a preselected bubble point temperature, comprising the steps of: (a) pressurizing the boil-off stream; (b) cooling the pressurized boil-off stream of step (a); (c) expanding the cooled, pressurized boil-off stream of step (b), thereby producing pressurized liquid; and (d) obtaining the preselected bubble point temperature of the pressurized liquid by performing at least one of the following steps:

i. before, during, or after one or more of steps (a) to (c), removing from the boil-off stream a first predetermined amount of nitrogen, and ii. before, during, or after one or more of steps (a) to (c), adding to the boil-off stream a second predetermined amount of one or more $C_{2+}$ hydrocarbons, wherein the first predetermined amount of the nitrogen removed and the second predetermined amount of the one or more $C_{2+}$ hydrocarbons added are controlled to obtain the preselected bubble point temperature of the pressurized liquid, and further comprising before step (d), determining the first predetermined amount of the nitrogen to be removed from the boil-off stream, and determining the second predetermined amount of the one or more $C_{2+}$ hydrocarbons to be added to the boil-off stream, both of said determinations being performed by determining the composition of the boil-off stream and performing an equation of state analysis to determine a pressurized liquid composition needed to obtain the preselected bubble point temperature in said pressurized liquid at a preselected pressure.

The amount of the one or more components removed and the amount of the additives added is controlled to obtain the preselected bubble point temperature of the pressurized liquid. The additive(s) may comprise, for example without limiting this invention, $C_{2+}$ hydrocarbons (e.g., propane, butane, pentane, etc.) or carbon dioxide.

DESCRIPTION OF THE DRAWINGS

The advantages of the present invention will be better understood by referring to the following detailed description and the attached drawings in which.

Figure 1:
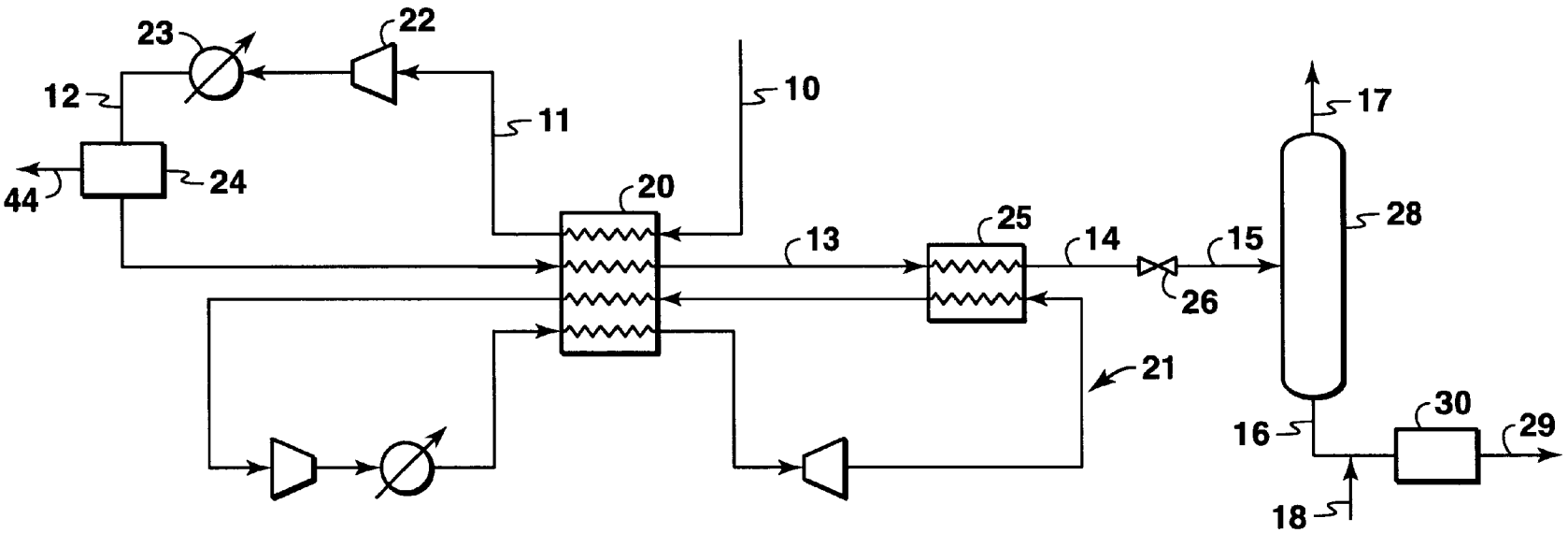
FIG. 1 schematically illustrates one process for liquefaction of boil-off according to this invention.

While the invention will be described in connection with its preferred embodiments, it will be understood that the invention is not limited thereto. On the contrary, the invention is intended to cover all alternatives, modifications, and equivalents which may be included within the spirit and scope of the present disclosure, as defined by the appended claims.

DETAILED DESCRIPTION OF THE INVENTION

The process of the present invention liquefies a multi-component boil-off stream comprising methane to produce a liquefied boil-off stream having substantially the same bubble point temperature as the bubble point temperature of a pressurized liquefied gas to which the liquefied boil-off stream is to be added. This invention is particularly well suited for reliquefaction of boil-off from liquefied natural gas having a temperature above about −112° C. (−170° F.), which is referred to in this description as PLNG.

The process of this invention is particularly well suited for liquefying boil-off generated from PLNG that contains significant quantities of components other than methane, such as nitrogen and $C_{2+}$ hydrocarbons. PLNG boil-off will contain a higher concentration of lower-molecular weight components of the PLNG than will the PLNG itself. If PLNG contains nitrogen, the boil-off gas from the PLNG will typically contain a higher concentration of nitrogen. Similarly, if the PLNG contains $C_{2+}$, the boil-off vapor will have a higher concentration of components that are more volatile than $C_{2+}$, such as methane. Since a boil-off stream will typically have a different composition than the liquefied gas that produced the boil-off, when the boil-off is liquefied, it will typically have a different bubble point temperature than such liquefied gas at a given pressure.

The term "bubble point temperature" as used in this specification is the temperature at which a liquid begins to convert to gas at a given pressure. For example, if a certain volume of PLNG is held at constant pressure, but its temperature is increased, the temperature at which bubbles of gas begin to form in the PLNG is the bubble point temperature. At the bubble point temperature, PLNG is saturated liquid.

One embodiment of the present invention will now be described with reference to FIG. 1. Boil-off feed stream 10 enters a liquefaction process by being passed through heat exchanger 20, which utilizes boil-off feed stream 10 for cooling. Boil-off feed stream 10 can result from evaporation during storage, transportation, and/or handling of any liquefied gas (not shown in FIG. 1). Boil-off feed stream 10 may come from LNG or from PLNG, for example.

Heat exchanger 20 may comprise one or more stages cooled by a conventional closed-cycle cooling loop 21. For example, cooling loop 21 may comprise a single or multi-component refrigeration system suitable for providing refrigeration. This invention is not limited to any type of heat exchanger 20. Suitable heat exchanger 20 may include for example plate-fin exchangers, spiral wound exchangers, and printed circuit exchangers, which all cool by indirect heat exchange. Nitrogen is a preferred refrigerant for closed-cycle refrigeration system 21, which is a well-known means of cooling by indirect heat exchange. The term "indirect heat exchange," as used in this description, means the bringing of two fluid streams into heat exchange relation without any physical contact or intermixing of the fluids with each other. The optimal coolant for closed-cycle cooling loop 21 and the optimal heat exchanger 20 can be determined by those having ordinary skill in the art taking into account the flow rate and compositions of fluids passing through heat exchanger 20.

After exiting heat exchanger 20, boil-off stream 11 is compressed by compressor 22. The power requirements of compressor 22 will depend in part on the preselected pressure for liquefied product stream 29. Compressor 22 boosts the pressure of boil-off stream 11 to a pressure above the preselected pressure of liquefied product stream 29, preferably the pressure of boil-off stream 11 is boosted to more than about 100 psia (700 kPa) above the preselected pressure of liquefied product stream 29, and more preferably between about 300 and about 600 pounds (2,070 to 4,140 kPa) above the preselected pressure of liquefied product stream 29.

Compressor 22 is shown in FIG. 1 as a single stage, which in most applications will be sufficient. It is understood, however, that in the practice of this invention a plurality of compressor stages or compressor units can be used (for example, three compression stages with two intercoolers). The last after-cooler is preferably positioned downstream from the last compression stage. In FIG. 1, only one after-cooler 23 is shown, preferably using ambient air or water as the cooling medium.

From after-cooler 23, boil-off stream 12 is optionally passed to a nitrogen rejection unit 24 for removal of a predetermined amount of nitrogen via rejection stream 44. The nitrogen removal can be carried out using any suitable nitrogen removal process of the kind that are well known in the art. For example, nitrogen may be removed by a cryogenic fractionation system, a molecular sieve system such as pressure swing adsorption, or a porous membrane system.

After exiting nitrogen rejection unit 24, compressed boil-off stream 12 is passed through heat exchanger 20 for additional cooling. From heat exchanger 20, boil-off stream 13 is passed through a second heat exchanger 25, which is also cooled by closed-cycle cooling loop 21. After passing through heat exchanger 25, boil-off stream 14 is passed to an expansion means, such as Joule-Thomson valve 26 to further reduce the temperature of boil-off stream 14. This isenthalpic reduction in pressure results in the flash evaporation of a gas fraction, liquefaction of the balance of the boil-off, and an overall reduction in temperature of both the boil-off fraction and the remaining liquid fraction in cooled boil-off stream 15. To produce a high pressure liquefied natural gas product stream 29 from boil-off feed stream 10 in accordance with the practice of this invention, the temperature of cooled boil-off stream 15 is preferably above about −112° C. (−170° F.). Boil-off stream 15 is passed to phase separator 28 from which reliquefied boil-off stream 16 is withdrawn and passed to a temporary storage container 30.

Also withdrawn from phase separator 28 is separated boil-off vapor stream 17, which is rich in methane and, depending on the nitrogen content, if any, of boil-off feed stream 10 and depending on the amount, if any, of nitrogen removed by nitrogen rejection unit 24, vapor stream 17 may also contain nitrogen. Vapor stream 17 may be used for any suitable purpose such as for pressurized fuel.

In accordance with the practice of this invention, the temperature of boil-off stream 14 can be controlled to regulate the amount of uncondensed vapor volume of vapor stream 17 to match fuel needs, such as, without limiting this invention, for powering the liquefaction process of the present invention and for other process fuel needs. The volume of vapor stream 17 will increase with increases in the temperature of boil-off stream 14. In one embodiment, if the fuel requirements of the liquefaction process are low, the temperature of stream 14 can be lowered. The desired temperature of boil-off stream 14 and the volume of vapor stream 17 can be regulated by adjusting the temperature, or more preferably the volume, of refrigerant of closed-loop cooling cycle 21 entering heat exchanger 25. Appropriate adjustments can be determined by those skilled in the art in light of the teachings of this description.

Liquefied product stream 29 from temporary storage container 30 can be combined with PLNG that produced the boil-off being liquefied by the process of FIG. 1 (boil-off feed stream 10). The liquefied product in container 30 has substantially the same temperature as the PLNG to which it is to be combined (the "to-be-combined PLNG") (not shown in FIG. 1). Preferably, such liquefied product has a temperature within 3 degrees Centigrade of the temperature of the to-be-combined PLNG. The desired preselected bubble point temperature of the liquefied product in container 30 can be obtained by performing at least one of the following steps:

(i) before, during, or after liquefaction of boil-off feed stream 10, removing from boil-off feed stream 10 a predetermined amount of one or more components having a vapor pressure greater than the vapor pressure of methane (such as $N_2$ removal by nitrogen rejection unit 24), and (ii) before, during, or after liquefaction of boil-off feed stream 10, adding one or more hydrocarbons having a molecular weight heavier than methane and having a vapor pressure less than the vapor pressure of methane to boil-off feed stream 10 (such as $C_{2+}$ hydrocarbons addition via additive stream 18 to reliquefied boil-off stream 16).

The amount of the one or more components removed and the amount of the one or more additives added are controlled to obtain the preselected bubble point temperature of the PLNG. The amount of additives to be added or components to be removed can be determined by performing a chemical analysis, using for example an in-line chromatograph, of the composition of boil-off feed stream 10. A conventional computer-assisted process simulator using well known equation-of-state analyses can be used to determine the amount of components, e.g., nitrogen, that should be rejected and/or the amount of additives, e.g., $C_{2+}$ hydrocarbons, that should be added to boil-off stream 10 to achieve the desired temperature at the pressure of product stream 29. Temporary storage container 30 can be used to collect reliquefied boil-off 16 for analysis prior to passing it as stream 29 to the main PLNG storage container (not shown in FIG. 1). The addition of additives and/or removal of components to/from boil-off stream 10 can be performed in the process of this invention either in a semi-batch or continuous mode. Appropriate temperature sensors are preferably installed in temporary storage container 30 or in phase separator 28 to help monitor the temperature of the PLNG being returned to the main PLNG storage container.

Although FIG. 1 shows additives being introduced by flow stream 18 to reliquefied boil-off stream 16, it should be understood that part or all of any additive addition may be at one or more other locations in the liquefaction process shown in FIG. 1, including addition of additives before start of reliquefaction of boil-off feed stream 10.

Figure 2:
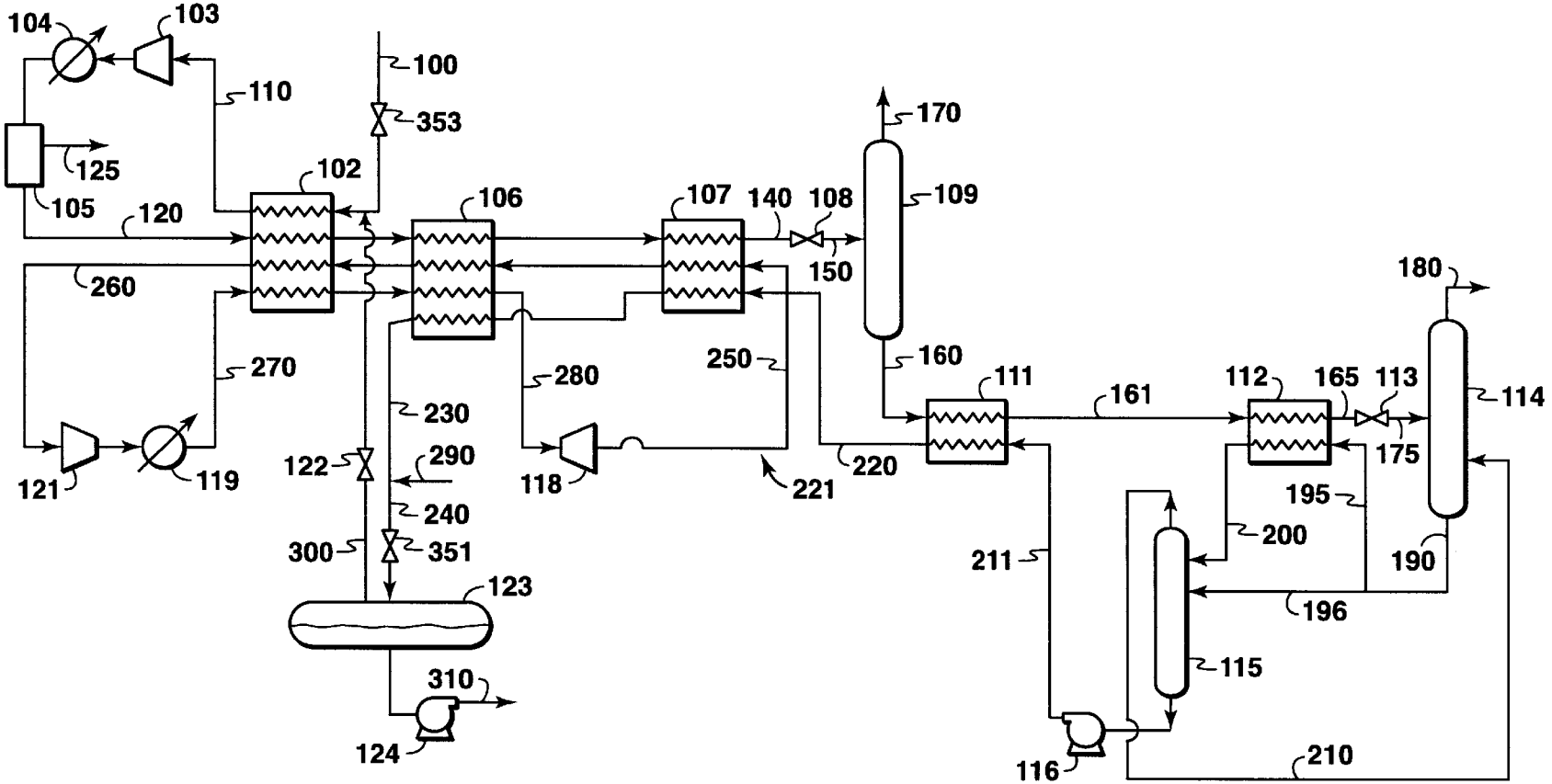
FIG. 2 schematically illustrates an embodiment of this invention in which the boil-off liquefaction process uses a fractionating column.

FIG. 2 illustrates another embodiment of the invention. Boil-off feed stream 100, containing nitrogen and hydrocarbons such as methane, is passed through regulator valve 353 to heat exchanger 102 where the cold of boil-off feed stream 100 is used to cool warmer boil-off stream 120 that is passed through heat exchanger 102. From heat exchanger 102 warmed boil-off stream 110 is compressed by one or more compressor stages 103 and then cooled by one or more after-coolers 104. Cooled boil-off stream 120 (which cooled boil-off stream 120 is nonetheless warmer than boil-off feed stream 100) may optionally be passed through a nitrogen rejection unit (NRU) 105 for removal of a preselected amount of nitrogen through rejection line 125. NRU 105 may be a molecular sieve (such as a pressure swing absorption or temperature swing process), membrane, distillation process, or any other suitable process that operates at non-cryogenic temperatures. NRU 105 may remove part or all of the nitrogen from cooled boil-off stream 120. After NRU 105, cooled boil-off is passed through heat exchangers 102, 106 and 107. Although heat exchangers 102, 106, and 107 are shown in FIG. 2 as separate units, these heat exchangers may also be packaged together in one box with, for example, a side feed inlet. After passing through heat exchanger 107, further cooled boil-off stream 140 is pressure expanded by expansion valve 108. Expanded boil-off stream 150 is then passed to phase separator 109. Removed component stream 170 withdrawn from separator 109 is enriched in nitrogen. Normally removed component stream 170 has no flow, except during startup (cool down) or during process upset conditions. Pressurized liquefied boil-off stream 160 withdrawn from the bottom of separator 109 is passed through heat exchanger 111 in which stream 160 is further cooled. Cooled liquefied boil-off stream 161 from heat exchanger 111 is passed through heat exchanger 112 for further cooling. Further cooled liquefied boil-off stream 165 is then passed to nitrogen fractionating column 114. Removable component stream 180 is enriched in nitrogen and liquid bottoms stream 190 is substantially depleted of nitrogen. A partial volume 195 of liquid bottoms stream 190 is passed through heat exchanger 112 to provide refrigeration duty for heat exchanger 112. The partial volume 195 of liquid bottoms stream 190 that was passed through heat exchanger 112 (stream 200) as well as the remaining volume 196 of liquid bottoms stream 190 that was not passed through heat exchanger 112 are both passed to phase separator 115. Phase separator 115 may also be an integral part of the nitrogen fractionating column 114. A vapor overhead stream 210 is withdrawn from phase separator 115 and returned to nitrogen fractionating column 114. Although heat exchangers 111 and 112 are shown in FIG. 2 as separate units, these heat exchangers can be combined in one unit.

Heat exchanger 112 operates as a reboiler for incorporation into nitrogen fractionating column 114 and also provides the final cooling for cooled liquefied boil-off stream 161 before fractionating column 114. The temperature of cooled liquefied boil-off stream 161 entering heat exchanger 112 can be controlled by having stream 160 or stream 211 bypass heat exchanger 111. If part or all of stream 160 or stream 211 is bypassed around heat exchanger 111, the feed temperature of stream 161 to heat exchanger 112 is warmer that it would otherwise be and more reboil duty can be generated in heat exchanger 112 than would otherwise be. Increasing the reboil duty of heat exchanger 112 can be used to produce more stripping vapor (vapor overhead stream 210) from separator 115, thereby removing more nitrogen from the liquid bottoms stream 190. In addition, partial volume 195 of stream 190 directed through exchanger 112 is used to affect the amount of stripping vapor 210 generated. Minimizing the temperature of stream 165, prior to expansion by expansion valve 113, reduces the amount of methane in removable component stream 180. Removable component stream 180 may be used as fuel in power-producing systems such as, without limiting this invention, gas turbines or pressurized steam generating heaters on a ship. From heat exchanger 112 stream 165 is passed through expansion valve 113. Expanded stream 175 is then passed through nitrogen fractionating column 114.

Bottom stream 220 from phase separator 115 is boosted in pressure by pump 116 and passed through heat exchangers 111, 107, and 106 to provide refrigeration duty to the heat exchangers. If the bubble point of liquid stream 230 needs to be further increased, additives such as $C_{2+}$ hydrocarbons can be added via additives stream 290 to obtain a desired bubble point temperature in stream 240. Stream 240 is then expanded by a suitable expansion means 351 to the desired bubble point pressure and the resulting expanded stream is passed to surge tank 123. Vapor stream 300 is preferably continuously withdrawn from surge tank 123 to assure that the liquid in surge tank 123 remains at a preselected bubble point temperature. PLNG stream 310 is typically returned via pump 124 to the pressurized liquid (e.g., PLNG) from which boil-off feed stream 100 is generated. Vapor stream 300 is recycled back into boil-off feed stream 100. A steady vapor stream 300 flow rate is preferred during the operation of the reliquefaction process illustrated in FIG. 2. Valve 122 in stream 300 is used to control the pressure in surge tank 123. The flow rate of vapor stream 300 can be increased by reducing the flow rate of refrigerant stream 270 of refrigeration cycle 221, and similarly the flow rate of vapor stream 300 can be decreased by increasing the flow rate of refrigerant stream 270. The flow rate of additives stream 290 is preferably flow-controlled, with the amount being added to achieve a desired bubble point temperature depending upon the particular composition of liquid stream 230.

The primary refrigeration for the liquefaction process for the embodiment illustrated in FIG. 2 is provided by closed refrigeration cycle 221. A cooled refrigerant stream 250 is passed through heat exchangers 107, 106, and 102. Refrigerant stream 260 exiting heat exchanger 102 is pressurized by one or more compressor stages 121 and one or more after-coolers 119. From after-cooler 119, refrigerant stream 270 is passed back through heat exchangers 102 and 106. Refrigerant stream 280 exiting heat exchanger 106 is passed through one or more turbo expanders 118 which cool the refrigerant. Without hereby limiting this invention, the refrigerant of refrigeration cycle 221 may comprise methane, ethane, propane, butane, pentane, carbon dioxide, and nitrogen, or mixtures thereof. Preferably, the closed-loop refrigeration system uses nitrogen as the predominant refrigerant.

Although not shown in the drawings, the equipment used in the embodiments illustrated in FIG. 1 and FIG. 2 would include a plurality of sensors for detecting various conditions in the liquefaction plant such as temperature, pressure, flow rates, and compositions. A plurality of controllers such as servo-controlled valves and one or more computers for controlling the valves can be used in operation of the plant. A computer-assisted control system can be used to provide the desired bubble point temperature of the liquid boil-off stream (for example, stream 29 of FIG. 1). The control system can respond to changes in plant conditions and can adjust various settings of the process equipment to eliminate departures from desired bubble point temperatures of the liquid product; the control system preferably therefore operates in a feedback mode.

EXAMPLE

A simulated mass and energy balance was carried out to illustrate the embodiment illustrated in FIG. 2, and the results are set forth in Table 1 below. The data were obtained using a commercially available process simulation program called HYSYS (available from Hyprotech Ltd. of Calgary, Canada); however, other commercially available process simulation programs, which are familiar to those of ordinary skill in the art, can be used to develop the data. The data presented in Table 1 are offered to provide a better understanding of the embodiment shown in FIG. 2, but the invention is not to be construed as limited thereto. The temperatures and flow rates are not to be considered as limitations upon the invention. The invention can have many variations in temperatures and flow rates in view of the teachings herein.

While this invention has been described primarily in relation to liquefied natural gas, the invention is not limited thereto, and may be useful with any liquid methane-rich gas. A person skilled in the art, particularly one having the benefit of the teachings of this specification, will recognize many modifications and variations to the specific processes disclosed above. For example, a variety of temperatures and pressures may be used in accordance with the invention, depending on the overall design of the system and the composition of the feed vapor. Also, the feed vapor cooling train may be supplemented or reconfigured depending on the overall design requirements to achieve optimum and efficient heat exchange requirements. As discussed above, the specifically disclosed embodiments and examples should not be used to limit or restrict the scope of the invention, which is to be determined by the claims below and their equivalents.

TABLE 1

| | | | | | | | | Composition | | |
|---|---|---|---|---|---|---|---|---|---|---|
| Stream | Phase | Pressure psia | Pressure kPa | Temp ° F. | Temp ° C. | Flow lbmole/hr | Flow kgmole/hr | ethane mole % | methane mole % | nitrogen mole % |
| 100 | Vapor | 410 | 2898 | −100 | −73 | 1098 | 498.3 | 0.70 | 94.8 | 4.6 |
| 110 | Vapor | 390 | 2691 | 55.7 | 13.5 | 1153 | 523.2 | 0.64 | 95.0 | 4.4 |
| 120 | Vapor | 543 | 3747 | 80.0 | 27.0 | 1153 | 532.2 | 0.64 | 95.0 | 4.4 |
| 140 | Liquid | 530 | 3657 | −220 | −139.7 | 1153 | 532.2 | 0.64 | 95.0 | 4.4 |
| 150 | Liquid | 500 | 3450 | −219.9 | −139.6 | 1153 | 532.2 | 0.64 | 95.0 | 4.4 |
| 160 | Liquid | 500 | 3450 | −219.9 | −139.6 | 1153 | 532.2 | 0.64 | 95.0 | 4.4 |
| 170 | Vapor | 500 | 3450 | −219.9 | −139.6 | 0 | 0 | — | — | — |
| 165 | Liquid | 490 | 3381 | −252 | −157.4 | 1153 | 532.2 | 0.64 | 95.0 | 4.4 |
| 175 | 2 phase | 18 | 124.2 | −264.1 | −164.2 | 1153 | 532.2 | 0.64 | 95.0 | 4.4 |
| 180 | Vapor | 17 | 117.3 | −265.9 | −165.2 | 128.0 | 58.1 | — | 61.2 | 38.8 |
| 190 | Liquid | 18.0 | 124.2 | −255.3 | −159.3 | 1075.0 | 487.8 | 0.69 | 99.2 | 0.10 |
| 200 | 2 phase | 18.0 | 124.2 | −254.4 | −158.8 | 1075.0 | 487.8 | 0.69 | 99.2 | 0.10 |
| 210 | Vapor | 18.0 | 124.2 | −254.4 | −158.8 | 49.6 | 22.5 | — | 98.9 | 1.1 |
| 220 | Liquid | 470 | 3243 | −228.0 | −144.1 | 1025.0 | 465.1 | 0.72 | 99.2 | 0.05 |
| 230 | Liquid | 462 | 3188 | −139.1 | −94.7 | 1025.0 | 465.1 | 0.72 | 99.2 | 0.05 |
| 240 | Liquid | 462 | 3188 | −138.2 | −94.2 | 1036.0 | 470.1 | 1.75 | 98.2 | 0.05 |
| 250 | Vapor | 220 | 1518 | −219.7 | −139.5 | 9033.0 | 4099.0 | — | 0 | 1.0 |
| 260 | Vapor | 207 | 1428 | 55.7 | 13.5 | 9033.0 | 4099.0 | — | 0 | 1.0 |
| 270 | Vapor | 725 | 5003 | 80.0 | 27.0 | 9033.0 | 4099.0 | — | 0 | 1.0 |
| 280 | Vapor | 715 | 4934 | −135.0 | −92.4 | 9033.0 | 4099.0 | — | 0 | 1.0 |
| 290 | Vapor | 465 | 3209 | −140.0 | −95.2 | 10.98 | 4.98 | 99.50 | 0.5 | — |
| 300 | Vapor | 410 | 2829 | −142.9 | −96.8 | 54.8 | 24.9 | 0.25 | 99.61 | 0.14 |
| 310 | Liquid | 415 | 2864 | −142.7 | −96.7 | 981.2 | 445.3 | 1.86 | 98.1 | 0.04 |

We claim:

1. A method of converting a boil-off stream comprising methane to a liquid having a preselected bubble point temperature, comprising the steps of:

(a) pressurizing the boil-off stream;

(b) cooling the pressurized boil-off stream of step (a);

(c) expanding the cooled, pressurized boil-off stream of step (b), thereby producing pressurized liquid; and (d) obtaining the preselected bubble point temperature of the pressurized liquid by performing at least one of the following steps:

i. before, during, or after one or more of steps (a) to (c), removing from the boil-off stream a first predetermined amount of one or more components having a vapor pressure greater than the vapor pressure of methane, and ii. before, during, or after one or more of steps (a) to (c), adding to the boil-off stream a second predetermined amount of one or more additives having a molecular weight heavier than the molecular weight of methane and having a vapor pressure less than the vapor pressure of methane, wherein the first predetermined amount of the one or more components removed and the second predetermined amount of the one or more additives added are controlled to obtain the preselected bubble point temperature of the pressurized liquid.

2. The method of claim 1 wherein the one or more components removed from the boil-off stream comprise nitrogen.

3. The method of claim 1 wherein the one or more additives added to the boil-off stream comprise one or more $C_{2+}$ hydrocarbons.

4. The method of claim 1 further comprising combining the pressurized liquid having the preselected bubble point temperature with a second pressurized liquid having substantially the same bubble point temperature.

5. The method of claim 4 wherein the second pressurized liquid produced the boil-off stream being liquefied.

6. The method of claim 1 further comprising before step (d), determining an amount of a first component of said one or more components to be removed from the boil-off stream, the first component having a vapor pressure greater than the vapor pressure of methane, and determining an amount of a first additive of said one or more additives to be added to the boil-off stream, the first additive having a molecular weight heavier than the molecular weight of methane and having a vapor pressure less than the vapor pressure of methane, both of said determinations being performed by determining the composition of the boil-off stream and performing an equation of state analysis to determine a pressurized liquid composition needed to obtain the preselected bubble point temperature in said pressurized liquid at a preselected pressure.

7. The method of claim 1 further comprising before step (d), determining the first predetermined amount of the one or more components to be removed from the boil-off stream, and determining the second predetermined amount of the one or more additives to be added to the boil-off stream, both of said determinations being performed by determining the composition of the boil-off stream and performing an equation of state analysis to determine a pressurized liquid composition needed to obtain the preselected bubble point temperature in said pressurized liquid at a preselected pressure.

8. A method of converting a boil-off stream comprising methane to a liquid having a preselected bubble point temperature, comprising the steps of:

(a) pressurizing the boil-off stream;

(b) cooling the pressurized boil-off stream of step (a);

(c) expanding the cooled, pressurized boil-off stream of step (b), thereby producing pressurized liquid; and (d) obtaining the preselected bubble point temperature of the pressurized liquid by performing at least one of the following steps:

i. before, during, or after one or more of steps (a) to (c), removing from the boil-off stream a first predetermined amount of nitrogen, and ii. before, during, or after one or more of steps (a) to (c), adding to the boil-off stream a second predetermined amount of one or more $C_{2+}$ hydrocarbons, wherein the first predetermined amount of the nitrogen removed and the second predetermined amount of the one or more $C_{2+}$ hydrocarbons added are controlled to obtain the preselected bubble point temperature of the pressurized liquid.

9. A method of converting a boil-off stream comprising methane to a liquid having a preselected bubble point temperature, comprising the steps of:

(a) pressurizing the boil-off stream;

(b) cooling the pressurized boil-off stream of step (a);

(c) expanding the cooled, pressurized boil-off stream of step (b), thereby producing pressurized liquid; and (d) obtaining the preselected bubble point temperature of the pressurized liquid by performing at least one of the following steps:

i. before, during, or after one or more of steps (a) to (c), removing from the boil-off stream a first predetermined amount of nitrogen, and ii. before, during, or after one or more of steps (a) to (c), adding to the boil-off stream a second predetermined amount of one or more $C_{2+}$ hydrocarbons, wherein the first predetermined amount of the nitrogen removed and the second predetermined amount of the one or more $C_{2+}$ hydrocarbons added are controlled to obtain the preselected bubble point temperature of the pressurized liquid, and further comprising before step (d), determining the first predetermined amount of the nitrogen to be removed from the boil-off stream, and determining the second predetermined amount of the one or more $C_{2+}$ hydrocarbons to be added to the boil-off stream, both of said determinations being performed by determining the composition of the boil-off stream and performing an equation of state analysis to determine a pressurized liquid composition needed to obtain the preselected bubble point temperature in said pressurized liquid at a preselected pressure.

* * * * *